US007950117B2

(12) United States Patent
Elhaj

(10) Patent No.: US 7,950,117 B2
(45) Date of Patent: May 31, 2011

(54) BROKEN HEART NECKLACE-URN

(76) Inventor: Antoine Elhaj, Sandusky, OH (US)

( * ) Notice: Subject to any disclaimer, the term of this patent is extended or adjusted under 35 U.S.C. 154(b) by 0 days.

(21) Appl. No.: 12/497,395

(22) Filed: Jul. 2, 2009

(65) Prior Publication Data

US 2010/0212355 A1 Aug. 26, 2010

Related U.S. Application Data

(63) Continuation-in-part of application No. 12/492,949, filed on Jun. 26, 2009, now Pat. No. 7,882,606, which is a continuation-in-part of application No. 12/468,861, filed on May 19, 2009, now Pat. No. 7,900,327, and a continuation-in-part of application No. 12/430,882, filed on Apr. 27, 2009, and a continuation-in-part of application No. 12/390,400, filed on Feb. 20, 2009, now Pat. No. 7,900,326.

(51) Int. Cl.
*A61G 17/00* (2006.01)

(52) U.S. Cl. ..... 27/1; 63/1.14; 63/900

(58) Field of Classification Search ..... 27/1; D99/5; 63/1.14, 3, 3.1, 18, 19, 900
See application file for complete search history.

(56) References Cited

U.S. PATENT DOCUMENTS

| | | | | |
|---|---|---|---|---|
| 4,542,631 | A * | 9/1985 | Esser, III | 63/31 |
| 5,158,174 | A * | 10/1992 | Hereford | 206/37 |
| 5,208,957 | A * | 5/1993 | Hereford | 27/1 |
| 5,755,116 | A * | 5/1998 | Sparacino et al. | 63/3 |
| 5,950,287 | A * | 9/1999 | Cacciatore et al. | 27/1 |
| 7,654,110 | B2 * | 2/2010 | Azar | 63/3.1 |
| 2004/0045316 | A1 * | 3/2004 | Naor | 63/1.14 |
| 2005/0081561 | A1 * | 4/2005 | Eggleston | 63/21 |
| 2006/0266079 | A1 * | 11/2006 | Lavictoire | 63/18 |
| 2009/0044565 | A1 * | 2/2009 | Fossas | 63/1.14 |
| 2009/0151392 | A1 * | 6/2009 | Fossas | 63/1.14 |
| 2010/0275649 | A1 * | 11/2010 | Eggleston | 63/1.14 |

OTHER PUBLICATIONS

"Cremation Jewelry" printed from the website <<http://www.perfectmemorials.com/heart-cremation-jewelry-c-285.html>> on Jun. 30, 2009.

* cited by examiner

*Primary Examiner* — William L. Miller
(74) *Attorney, Agent, or Firm* — Ronald J. Koch

(57) ABSTRACT

A complementary pair of broken heart shaped urn pendants, each having an access port, magnet, jagged inner surface, curved outer surface, clasp, front vertical wall, and rear vertical wall, and means for removably securing the pair together.

2 Claims, 5 Drawing Sheets

BROKEN HEART NECKLACE-URN

CLAIM OF PRIORITY BASED ON COPENDING APPLICATION

Claims benefit of utility application Ser. Nos. 12/492,949, 12/468,861, 12/390,400 & 12/430,882

The present application is a continuation in part of patent application Nos:

Ser. No. 12/492,949, of Antoine Elhaj, filed Jun. 26, 2009 now U.S. Pat. No. 7,882,606, entitled "Coffin Carriage Assembly";

Ser. No. 12/468,861 of Antoine Elhaj, filed May 19, 2009 now U.S. Pat. No. 7,900,327, entitled "Broken Heart Shaped Vault";

Ser. No. 12/430,882 of Antoine Elhaj, filed Apr. 27, 2009, entitled "Broken Heart Shaped Coffin";

and Ser. No. 12/390,400 of Antoine Elhaj, filed Feb. 20, 2009 now U.S. Pat. No. 7,900,326, entitled "Broken Heart Shaped Coffin" and based on which priority is herewith claimed under 35 U.S.C. 120 and the disclosures of which are incorporated herein by reference in their entirety as if fully rewritten herein.

CROSS REFERENCE TO RELATED APPLICATIONS

Application Ser. No. 12/492,949, filed Jun. 26, 2009; Ser. No. 12/468,861, filed May 19, 2009; Ser. No. 12/390,400, filed Feb. 20, 2009; Ser. No. 12/430,882, filed Apr. 27, 2009.

FEDERALLY SPONSORED RESEARCH

Not Applicable

SEQUENCE LISTING, TABLE, OR COMPUTER PROGRAM COMPACT DISK APPENDIX

Not Applicable

BACKGROUND AND SUMMARY

The present invention relates generally to urns and specifically to pendants and keys adapted to be urns. A broken heart shaped urn pendant can be worn alone as a necklace or in combination with a second broken heart shaped urn pendant (that is a mirror image of the first pendant) to form a unitary heart. Thus, the ashes of one or two persons or pets can be worn as jewelry. Additionally, a key is provided that has an inner portion adapted for use as an urn.

REFERENCE NUMERALS IN DRAWINGS

Figure 1:
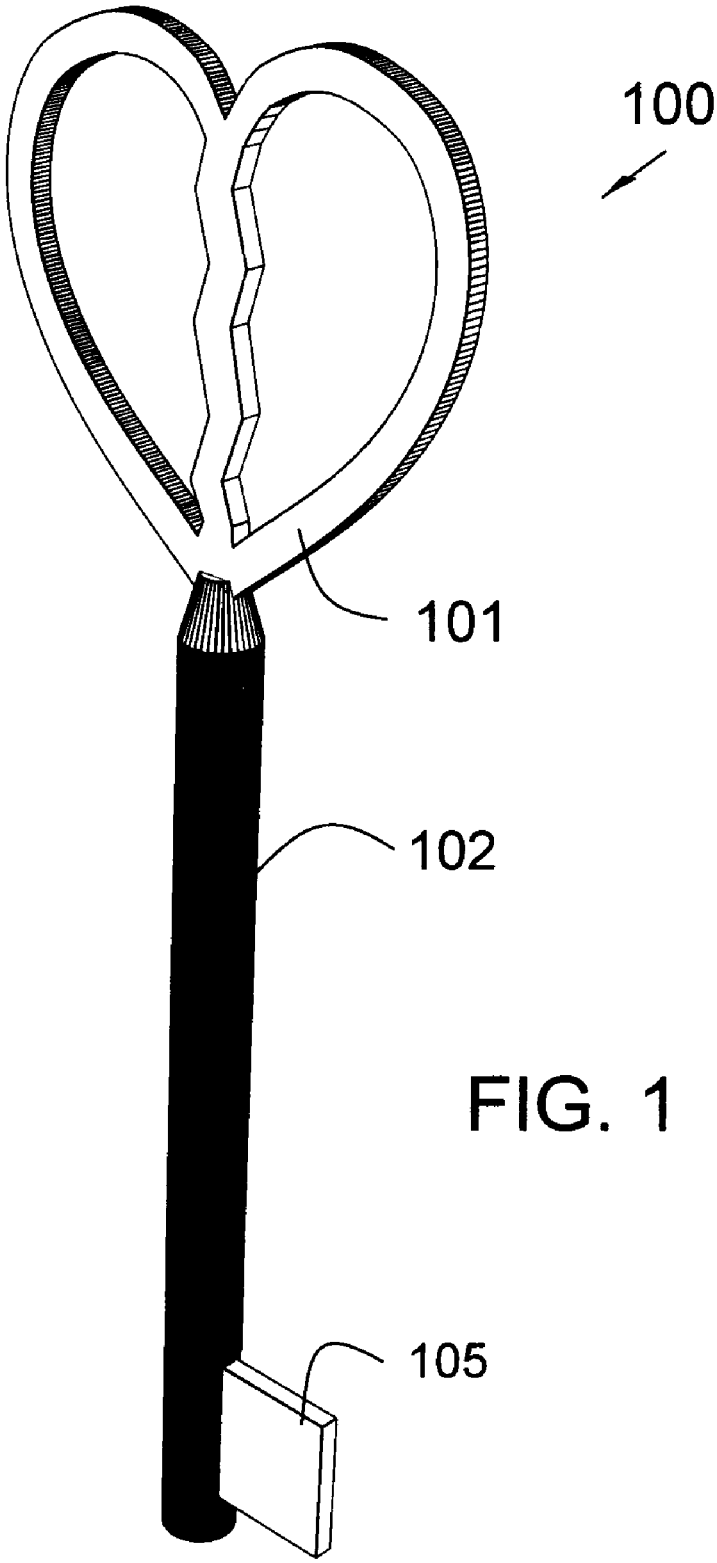
FIG. 1 depicts a perspective view of one embodiment of the key-urn of the present invention
Figure 2:
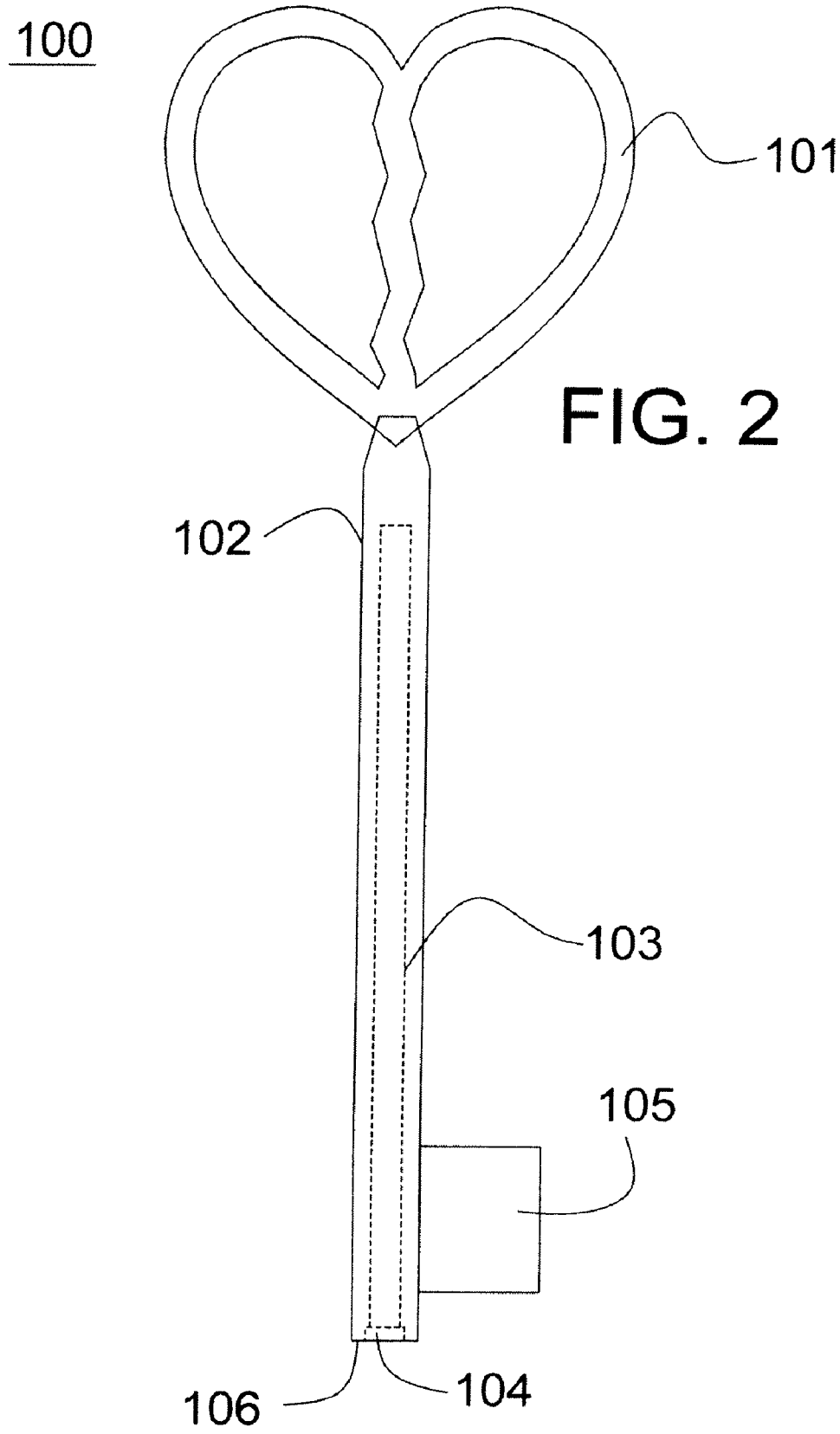
FIG. 2 depicts a front view of one embodiment of the key-urn of the present invention
Figure 4:
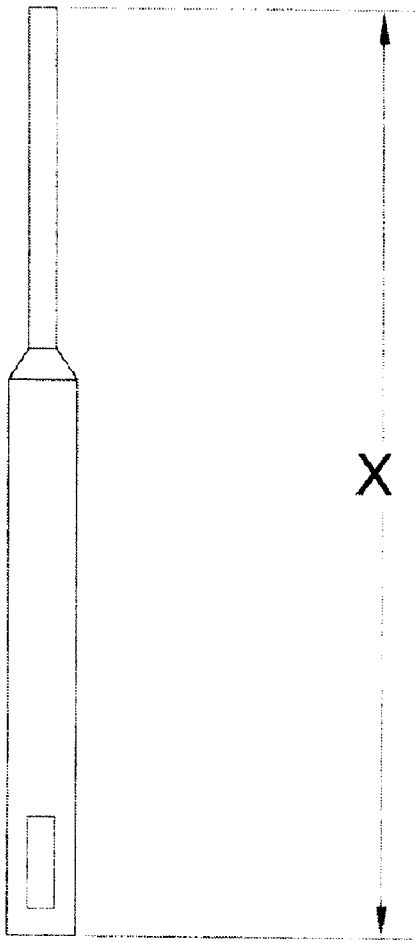
FIG. 4 depicts a side view of one embodiment of the key-urn of the present invention
Figure 3:
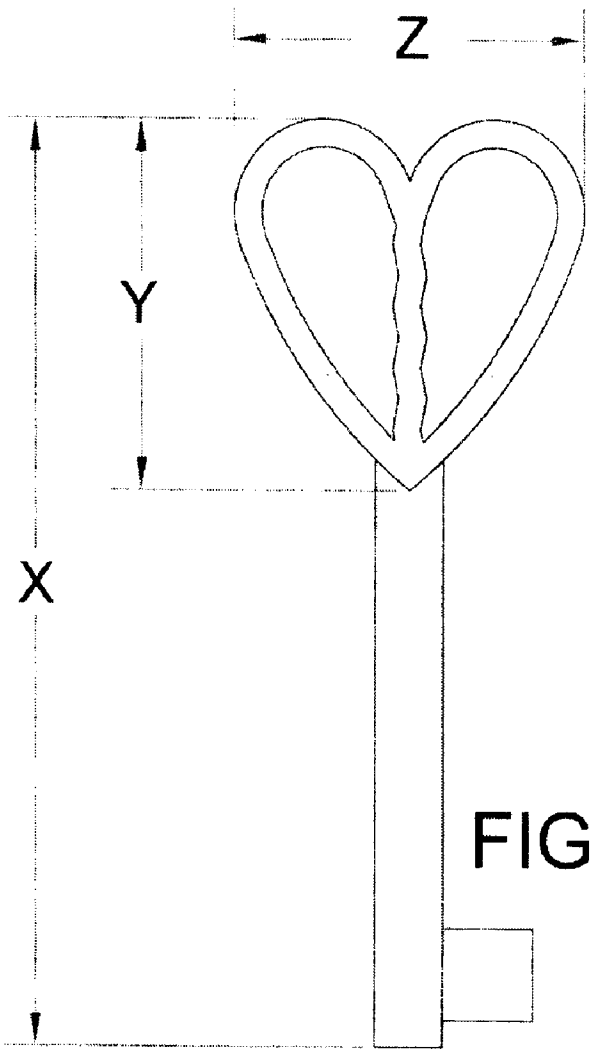
FIG. 3 depicts a front view of one embodiment of the key-urn of the present invention
Figure 5:
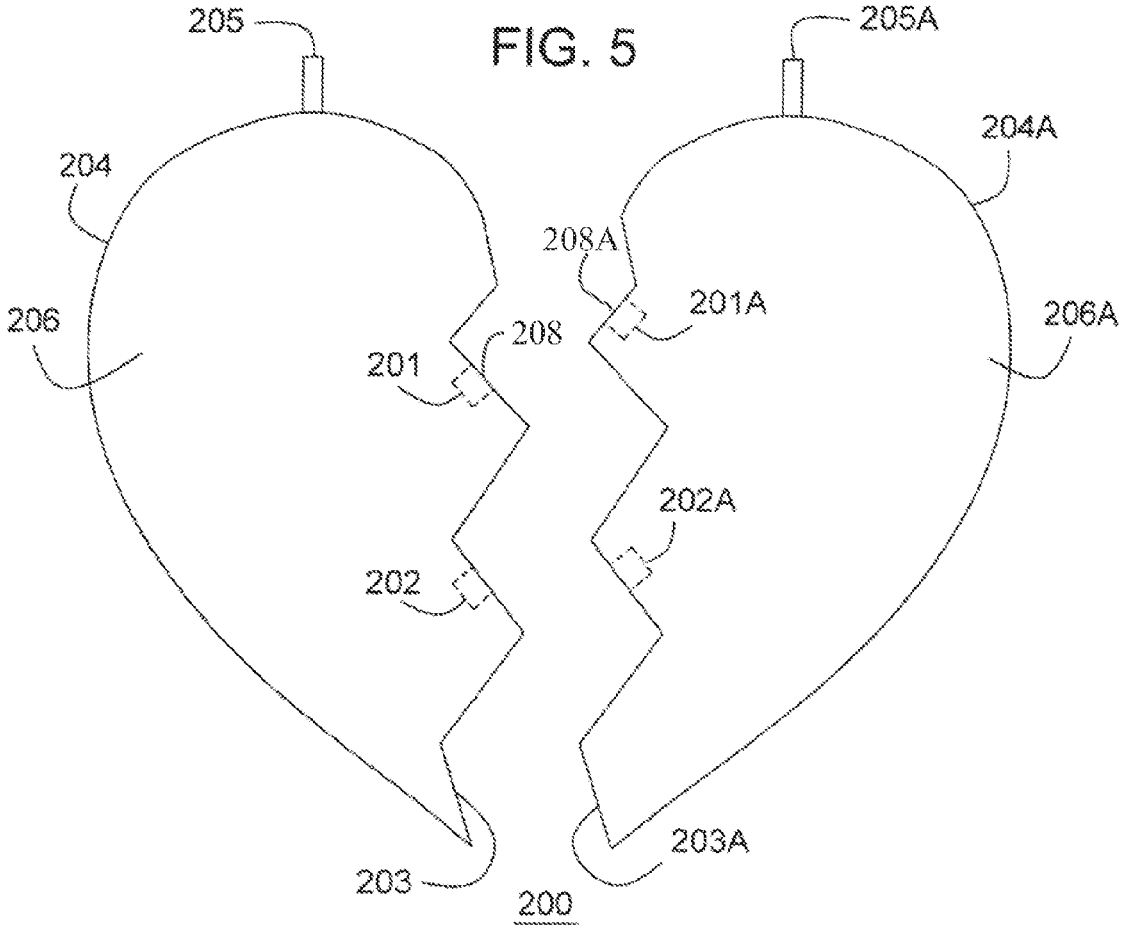
FIG. 5 depicts a front view of one embodiment of the pendant-urn of the present invention

The table below lists the reference numerals employed in the figures, and identifies the element designated by each numeral.

100 key 100
101 key handle 101
102 key shaft 102
103 shaft inner chamber 103 of key
104 chamber cap 104 of key shaft
105 lock engagement means 105 of key shaft
106 key bottom 106
200 broken heart shaped urn pendant 200
201 access port 201 of broken heart shaped urn
202 magnet 202 of broken heart shaped urn
203 jagged inner surface 203 of broken heart shaped urn
204 curved outer surface 204 of broken heart shaped urn
205 clasp 205 of broken heart shaped urn
206 front vertical wall 206 of broken heart shaped urn
207 rear vertical wall 207 of broken heart shaped urn
208 cap
200A complementary broken heart shaped urn pendant 200A
201A access port 201A of complementary broken heart shaped urn
202A magnet 202A of complementary broken heart shaped urn
203A jagged inner surface 203A of complementary broken heart shaped urn
204A curved outer surface 204A of complementary broken heart shaped urn
205A clasp 205A of complementary broken heart shaped urn
206A front vertical wall 206A of broken heart shaped urn
207A rear vertical wall 207A of broken heart shaped urn
208A cap

DETAILED DESCRIPTION

A broken heart shaped urn pendant 200 comprises, access port 201, magnet 202, jagged inner surface 203, curved outer surface 204, clasp 205, front vertical wall 206, and rear vertical wall 207.

Curved outer surface 204 forms essentially a half-heart shape; jagged inner surface 203 forms essentially the broken shape; and front and rear vertical walls 206, 207 complete the vessel.

Access port 201 has a removable cap 208 for sealing the vessel. It is preferably upwardly oriented so as not to spill the ashes when the cap is removed when the urn is upright. Ashes can be placed inside of the urn via the access port for storage and remembrance.

In one embodiment, access port 201 and removable cap are recessed in the jagged inner surface so as not to protrude outwardly.

In one embodiment, a second, complementary broken heart shaped urn pendant 200A, is provided to be conjoined to a first pendant 200 to form a heart shape, and has access port 201A, magnet 202A, jagged inner surface 203A, curved outer surface 204A, clasp 205A, front vertical wall 206A, and rear vertical wall 207A.

The arrangement of curved outer surface 204A, jagged inner surface 203A, front and rear vertical walls 206A, 207A, and access port 201A (with removable cap 208A) is analogous to (except being a mirror image of) curved outer surface 204, jagged inner surface 203, front and rear vertical walls 206, 207, and access port 201.

In one embodiment, means for removably connecting the complementary pendants to each other comprises, complementary magnets 202, 202A each placed in a recess (i.e. flush mounted) on the jagged inner surface 203, 203A of each urn in a cooperating arrangement. The magnets are chosen with appropriate pole alignment so they are not repelled from each other.

In one embodiment, means for removably connecting the complementary pendants to each other comprises, a magnet 202 placed in a recess on the jagged inner surface 203 of one of the urns, the other urn having a coinciding ferrous portion (taking the place of magnet 202A) on jagged inner surface 203A. Thus, the complementary urns as described can be worn either separately or conjoined to form a heart shape.

Access port 201, 201A (each with removable cap) are preferably recessed in the jagged inner surface of each urn so as not to protrude from the surface. Though not essential, this arrangement is advantageous in that the access ports are not visible when the urns are worn in a complementary fashion.

A broken heart shaped urn key comprises key 100, key handle 101, key shaft 102, shaft inner chamber 103, chamber cap 104, lock engagement means 105, and key bottom 106.

Figure 6:
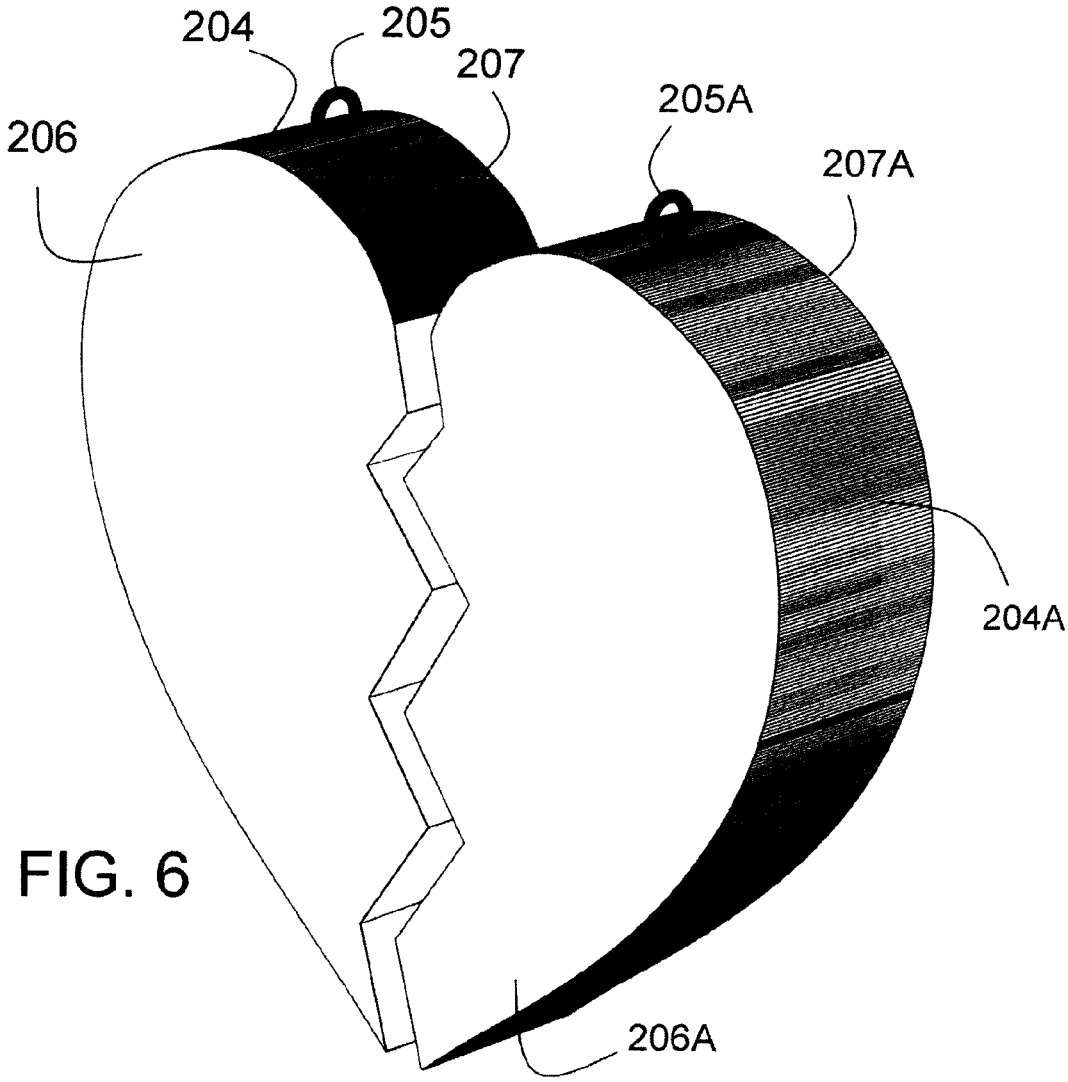
FIG. 6 depicts a perspective view of one embodiment of the pendant-urn of the present invention

Handle portion 101 is shaped like a complementary broken heart pair in the frontal view; tubular shaft 102 is connected at an upper portion to handle 101; lock engagement means (a.k.a. tooth, etc.) 105 is disposed approximate a bottom portion 106 of shaft 102 which has an opening in the bottom thereof and forms an inner chamber 103 within the shaft; and removable cap (e.g. a threaded screw) 104 is used for sealing the opening; Thus, the inner chamber can be filled with ashes and sealed with the removable cap. In one embodiment (FIG. 6), the key has dimensions of X=2.5 inches, Y=1 inch, and Z=0.97 inches.

What is claimed is:

1. Complementary broken heart shaped urn pendants for storing ashes of a deceased comprising:

first and second broken heart shaped urn pendants, each having, a curved outer surface forming a half-heart shape and including a clasp for attachment to a necklace, a jagged inner surface forming a broken shape, front and rear planar, vertical walls extending between the curved outer surface and jagged inner surface such that the curved outer surface, jagged inner surface, and front and rear planar vertical walls cooperate to define the broken heart shaped urn pendant, the jagged inner surface having an access port which receives the ashes, the access port being upwardly oriented to avoid spillage of the ashes, and a cap for closing the access port, the access port and cap being recessed in the jagged inner surface so as not to protrude outwardly therefrom, means for removably connecting the first and second broken heart shaped urn pendants to each other at the jagged inner surfaces thereof to form a heart shaped pendant, wherein the means comprises complementary magnets placed in a recess on the jagged inner surface of each urn pendant, the complementary magnets being the only means which connects the first and second broken heart shaped urn pendants to each other.

2. Complementary broken heart shaped urn pendants for storing ashes of a deceased comprising:

first and second broken heart shaped urn pendants, each having, a curved outer surface forming a half-heart shape and including a clasp for attachment to a necklace, a jagged inner surface forming a broken shape, front and rear planar, vertical walls extending between the curved outer surface and jagged inner surface such that the curved outer surface, jagged inner surface, and front and rear planar vertical walls cooperate to define the broken heart shaped urn pendant, the jagged inner surface having an access port which receives the ashes, the access port being upwardly oriented to avoid spillage of the ashes, and a cap for closing the access port, the access port and cap being recessed in the jagged inner surface so as not to protrude outwardly therefrom, means for removably connecting the first and second broken heart shaped urn pendants to each other at the jagged inner surfaces thereof to form a heart shaped pendant, wherein the means comprises a magnet placed in a recess on the jagged inner surface of one of the urn pendants and a cooperating ferrous portion on the jagged inner surface of the other urn pendant, the cooperating magnet and ferrous portion being the only means which connects the first and second broken heart shaped urn pendants to each other.

* * * * *